US006130950A

United States Patent [19]

Martin

[11] Patent Number: 6,130,950

[45] Date of Patent: Oct. 10, 2000

[54] HEARING AID WHICH ALLOWS NON-COMPUTERIZED INDIVIDUAL ADJUSTMENT OF SIGNAL PROCESSING STAGES

[75] Inventor: Raimund Martin, Eggolsheim, Germany

[73] Assignee: Siemans Augiologische Technik GmbH, Erlangen, Germany

[21] Appl. No.: 08/874,148

[22] Filed: Jun. 13, 1997

[30] Foreign Application Priority Data

Jun. 26, 1996 [DE] Germany ..... 196 25 639

[51] Int. Cl.[7] ..... H04R 25/00

[52] U.S. Cl. ..... 381/312; 381/314; 381/320; 381/321; 381/323

[58] Field of Search ..... 381/320, 321, 381/312, 314, 323, 109, 330

[56] References Cited

U.S. PATENT DOCUMENTS

| | | | |
|---|---|---|---|
| 4,887,299 | 12/1989 | Cummins | 381/312 |
| 4,947,432 | 8/1990 | T Pholm | 381/312 |
| 5,337,364 | 8/1994 | Fitch | 381/68.3 |
| 5,404,407 | 4/1995 | Weiss | 381/68 |
| 5,463,692 | 10/1995 | Fackler | 381/312 |
| 5,604,812 | 2/1997 | Meyer | 381/68.2 |
| 5,636,285 | 6/1997 | Sauer | 381/68.2 |
| 5,687,241 | 11/1997 | Ludvigsen | 381/312 |
| 5,710,820 | 1/1998 | Martin et al. | 381/68.4 |

FOREIGN PATENT DOCUMENTS

| | | |
|---|---|---|
| 0 341 903 | 11/1989 | European Pat. Off. . |
| 0 676 909 | 10/1995 | European Pat. Off. . |
| OS 43 32 250 | 3/1995 | Germany . |

*Primary Examiner*—Huyen Le
*Assistant Examiner*—Dionne Harvey
*Attorney, Agent, or Firm*—Hill & Simpson

[57] ABSTRACT

A hearing aid has a microphone, a signal processing chain having a series of signal processing levels, a signal output transducer, a memory in which at least one set of parameters allocated to a hearing situation is stored that enables matching of the parameters of the signal processing stages to the hearing impairment of the wearer. Adjustment elements independent of the signal processing stage are provided, and the allocation of the adjustment elements 9 to the individual signal processing stages can be selectively determined. Adjustment of the respective signal processing stages can be accomplished in a non-computerized manner using the adjustment elements, thereby allowing the hearing aid to be used in countries and regions wherein personal computers are not readily available or accessible.

10 Claims, 1 Drawing Sheet

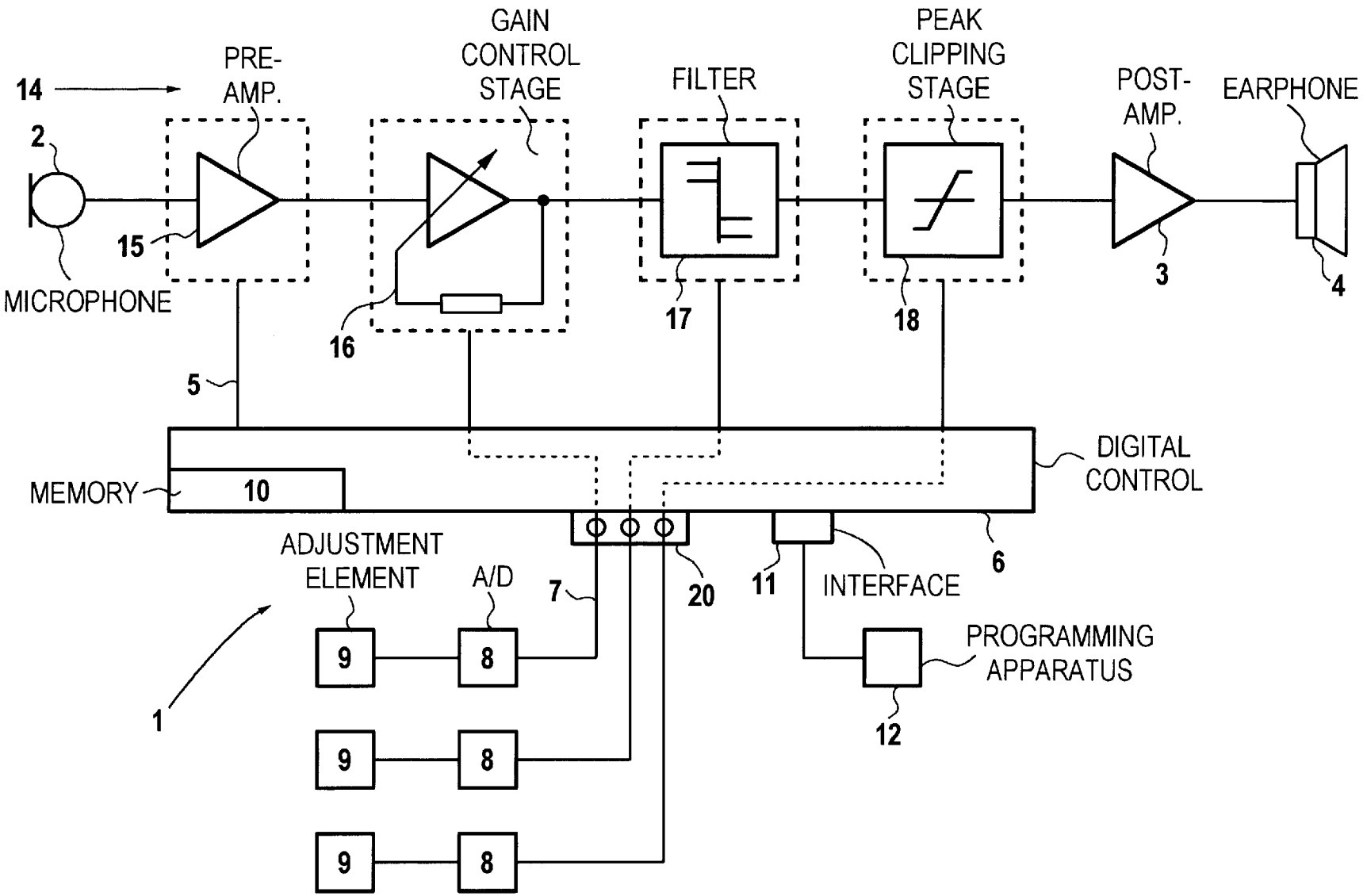
EARPHONE
4
POST-AMP.
3
PEAK CLIPPING STAGE
18
FILTER
17
GAIN CONTROL STAGE
16
PRE-AMP.
15
14
2
MICROPHONE
5
DIGITAL CONTROL
6
MEMORY
10
INTERFACE
11
PROGRAMMING APPARATUS
12
20
7
A/D
8
ADJUSTMENT ELEMENT
9
1

HEARING AID WHICH ALLOWS NON-COMPUTERIZED INDIVIDUAL ADJUSTMENT OF SIGNAL PROCESSING STAGES

BACKGROUND OF THE INVENTION

1. Field of the Invention

The present invention is directed to a hearing aid of the type having at least one microphone, a signal processing unit with a series of signal processing stages, a signal output transducer, a memory in which at least one set of parameters allocated to a hearing situation can be stored, which, when the hearing situation is present, enables matching of the parameters of the signal processing stages to the wearer's hearing impairment, and adjustment means for individually matching the respective signal processing stages.

2. Description of the Prior Art

A hearing aid of the above type is known from German OS 44 19 901, whose operation and/or control ensues by means of code words spoken by the hearing-impaired person. For this purpose, in a programmable embodiment of the hearing aid, transmission characteristics matched to different hearing situations/environmental situations are stored, which can be selected by means of allocated code words such as e.g. "program 1" or "program 2." Such a hearing aid must be individually matched (configured) by a hearing aid acoustician, using a programming device, at the time it is first given to the hearing-impaired person. This makes the use of such hearing aid devices impossible in countries that do not have the necessary infrastructure (state of technical development, availability of PCs, etc.).

From German OS 43 32 250, a programmable hearing aid is known that can be switched to two different environmental acoustic situations. For this purpose, two circuits are connected via switching means. This connection enables switching of predetermined matching parameters to the different environmental situation. The adjustment means, however, remain dependent on the signal processing stages; exchange takes place only between predetermined matching parameters. The hearing aid requires programming for the individual matching, and in addition is of expensive construction.

German OS 36 42 828 discloses a remotely controllable programmable hearing aid in which a first memory contains a number of programs for parameters representing different transmission characteristics of the hearing aid, as well as a control panel for the selective construction of each set of parameters. This hearing aid also has to be programmed individually upon being issued to the hearing-impaired person.

A programmable circuit for hearing aids is known from European Application 0 676 909. This circuit is distinguished by low power consumption and versatility of use. This is achieved because only those signal processing stages, such as e.g. filters, preamplifier, AGC and the like, that are required for the specific application, are activated by programming. In addition, the parameters of the signal processing stages, such as e.g. amplification, are determined in this programming process. A disadvantage of this known circuit is that the settings are exclusively programmable, thus a modification, e.g., of filter bandwidth or AGC threshold, requires the presence of corresponding technical infrastructure and expert knowledge.

SUMMARY OF THE INVENTION

An object of the present invention is to provide a hearing aid of the above-described general type that allows an individual adjustment of the signal processing stages even in countries with an infrastructure which is not technically sophisticated, and which has a reduced manufacturing cost.

This object is achieved in an inventive hearing aid having at least one adjustment element independent of the signal processing stages, with the allocation of the adjustment element to the individual signal processing stages ensuing selectively. Thus, for example, a single adjustment element can have at one time the significance "NL" (treble filter) and in another apparatus can have the significance "AGC" (automatic gain control). This determination can ensue in the manufacturing process or subsequently thereto, so that the determination of which signal processing stages are to be influenced can depend on the audiometric data of the future wearer.

In an embodiment, the hearing aid circuit is provided with a digital control, and an allocation of an adjustment element to the individual signal processing stages ensues by means of programming. This enables the allocation to take place after the termination of the actual manufacturing process. This allows standard apparatuses to be manufactured, since the wearer-specific preconditions do not have to be taken into account until the programming. In this way, the multiplicity of different apparatuses can be reduced and the piece costs can be minimized.

According to the invention, the allocation of the adjustment element to individual signal processing stages can be stored in a memory. This design enables the allocation of an adjustment element to different signal processing stages to be "reprogrammable." In this way, a matching to a changing hearing capacity, or matching to other wearers, can be realized.

In another embodiment the number of adjustment elements is fewer than the number of signal processing stages. The number of adjustment elements can advantageously be kept small by means of the selective allocation. This has an advantageous effect on the dimensions of the hearing aid. In addition, costs can be saved by the omission of unnecessary adjustment elements.

In addition, it is possible for the digital control to have a standard setting that can be changed for those signal processing stages allocated to an adjustment element. By means of this standard setting, it is ensured that a hearing aid equipped with a circuit of this sort is capable of functioning from the beginning. All signal processing stages are thus assigned parameters, with access being possible to those signal processing stages to which an adjustment element is allocated.

In a further embodiment several sets of parameters can be stored, and can be selectively retrieved. This offers the advantage that different hearing aid programs can be realized. For example, a set of parameters can be stored that is adapted for telephone conversations, i.e. for a limited frequency range. The retrieval of the individual parameter sets can ensue e.g. by means of a selector switch. The wearer can thus influence the way in which the received signal is processed.

In another embodiment, the adjustment elements are mechanical adjustment elements. In this way, the adjustment procedures or matching procedures can be carried out easily. Resistance potentiometers (trimmers) or the like can be used as adjustment elements, whose adjustment can, for example, take place by means of standardly available screwdrivers or the like. In addition, this version allows the adjustment to be carried out when a reprogramming of the parameters would not be possible due to unavailability of programming equipment or a lack of programming knowledge. In addition, mechanical adjustment means can be exchanged easily, if necessary.

In order to ensure that the digital control can process the parameters of the adjustment elements, it is possible within the scope of the invention to supply the parameters of the adjustment elements to the control in digitized form via analog/digital converters. These values can be acquired precisely by means of the digital control. In particular, time- and cost-intensive measurement procedures for the determination of characteristics of the adjustment elements can be omitted. This offers advantages both when the adjustment means are used for the first time and if an exchange is required later.

The operation of the analog/digital converter preferably ensues intermittently. The intermittent operation ensures that the power consumption of the analog/digital converter can be kept low, enabling the use of smaller, less powerful batteries. In this way, the outer dimensions of the hearing aid can be reduced. The switching of the analog/digital converter is particularly useful because its operation is required only for the adjustment process.

Particularly for size reduction, it is possible according to the invention for the adjustment elements to be contained in a unit that can be detached from the circuit. In order to ensure the adjustability of e.g. trimmers, it is required to provide them with e.g. an adjustment axle. In order for example to ensure reliable access by a screwdriver, this axle must have certain minimum dimensions. These dimensions are not required by the circuit-related aspects, but have a significant influence on the outer dimensions. The connection of a removable adjustment element unit can ensue via simple plug contacts to the digital control. Moreover, in this construction the use of precision adjustment elements is possible, so that the adjustment of individual parameters can take place with high precision and in a shorter time.

The signal processing can alternatively take place in analog fashion. Existing equipment, already in use e.g. for repairing conventional analog devices, can in principle also be used both for maintenance of proper operation and for repair. In this way, a high level of acceptance of the inventive circuit as a component of a hearing aid device, and ensuring service for these apparatuses, can be expected.

As an alternative, the parameter adjustment can ensue digitally, so that the advantages that result from digital signal processing can also be realized in hearing aids that are equipped with an inventive circuit.

DESCRIPTION OF THE DRAWINGS

The single FIGURE is a schematic block diagram of a hearing aid constructed in accordance with the principles of the present invention.

DESCRIPTION OF THE PREFERRED EMBODIMENTS

The FIGURE shows a circuit 1 of the inventive hearing aid with an acousto-electrical input transducer such as a microphone 2, signal processing stages, a post-amplifier 3 and an electroacoustical output transducer in the form of an earphone 4. In addition, the circuit 1 has a digital control 6 connected to the signal processing stages via connections 5. In addition, the digital control 6 is connected with a total of three individual adjustment elements 9, e.g. mechanical adjustment elements (rotating potentiometers), via connecting links 7 (e.g. copper line) and analog/digital converters 8. It can be seen easily that the number of adjustment elements 9 is smaller than the number of signal processing stages. Each of the three adjustment elements 9 is allocated to one particular signal processing stage.

The allocation is shown schematically on the basis of the dotted lines inside the digital memory 6. In addition, a memory 10, as well as an interface 11 for connecting a programming apparatus 12, is shown as a component of the digital control 6.

In the circuit 1, the signal processing stages are shown as (from the microphone 2 in the direction of the arrow 14): pre-amplifier 15, automatic gain control 16 (AGC), filter 17, as well as a peak clipping stage 18.

The "identity" of the signal processing stages is stored in the memory 10, e.g. a PROM, in order to enable the allocation of the adjustment elements. The memory 10 is configures e.g., by means of the digital control 6, with the corresponding information.

After the circuit 1 has been manufactured in terms of hardware, the digital control 6 is brought into connection with a programming apparatus 12 via the interface 11. An allocation of the adjustment elements 9 to the individual signal processing stages ensues via this programming apparatus 12. This can take place e.g., by addressing in the bus system. After these allocations are determined, they are read out from the programming apparatus 12 into the digital control 6 via the interface 11, and are stored in the memory 10.

With respect to function, the circuit 1 then consists of a microphone 2, a preamplifier 15, AGC 16, filter 17, peak clipping 18 and a post-amplifier 3 and loudspeaker 4, with adjustment elements 9 allocated respectively to the signal processing stages AGC 16, filter 17 and peak clipping 18, as shown schematically by the broken lines. The additional components of the circuit, to which no adjustment elements 9 is allocated (e.g. pre-amplifier 15) are operated via a standard setting of the digital control 6. For the wearer of a hearing aid equipped with this circuit 1, the type of programming is of no importance, and is not determinable.

Changes of the characteristic values of the signal processing stages can now be carried out via the adjustment elements 9. Thus, for example the value for the bandwidth of the filter 17 can be matched to the hearing curve of the user by alteration of adjustment values using the allocated adjustment elements 9. The standard settings are thereby modified, and the circuit 1 is matched to the purposes of individual use.

The adjustment ensues in such a way that the analog values emitted by the respective adjustment elements 9, e.g., trimmers, are supplied to the digital control 6 via the analog/digital converter 8 and the connecting link 7. An "evaluation" ensues here, as well as, via connecting links 5, the correction of the adjustment values of the corresponding signal processing stage.

In the circuit 1, the connecting links 7 can be formed by plug connections 20. In this version it is possible to match the number of adjustment elements 9 to the number of signal processing stages. There likewise exists the possibility of removing the adjustment elements 9 with the analog/digital converter 8 after the termination of the adjustment process.

It is the aim of the above-described embodiments to keep the number of components small in order to achieve cost advantages on the one hand, and also to achieve flexibility with respect to size reduction of the circuit 1.

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing aid comprising:

a hearing aid housing;

an acoustoelectrical input transducer in said hearing aid housing which produces a signal, an electroacoustical output transducer in said hearing aid housing, a signal path in said hearing aid housing between said acoustoelectrical input transducer and said electroacoustical output transducer, and distal processor means in said signal path, having a plurality of digital signal processing stages, for acting on said signal to produce a processed signal supplied to said electroacoustical output transducer;

a digital memory in said hearing aid housing, accessible by said signal processing stages, in which setting parameters for said signal processing stages are stored;

adjustment means, including a plurality of manually actuatable mechanically adjustable trimmers permanently mounted for user access at an exterior of said hearing aid housing and respectively allocated to said signal processing stages, and a plurality of analog-to-digital converters respectively connected between said mechanically adjustable trimmers and said signal processing stages, for independently and separately selectively adjusting the respective signal processing stages by supplying digital adjustment signals thereto dependent on mechanical adjustment of said trimmers for matching said signal processing stages to each other in a hearing situation; and programmable means for selectively allocating said mechanically adjustable trimmers to said processing stages.

2. A hearing aid as claimed in claim 1 further comprising a further memory for storing respective allocations of said mechanically adjustable trimmers to said processing stages.

3. A hearing aid as claimed in claim 1 wherein the plurality of mechanically adjustable trimmers is less than the plurality of said signal processing stages.

4. A hearing aid as claimed in claim 1 further comprising digital control means, connected to each of said processing stages, for, in a hearing situation, setting each of said signal processing stages to a standard setting using said parameter stored in said memory, and wherein said adjustment means comprises means for modifying a setting of a signal stage allocated to a mechanically adjustable trimmer.

5. A hearing aid as claimed in claim 1 wherein said memory means comprises means for storing a plurality of different sets of parameters for different hearing situations.

6. A hearing aid as claimed in claim 5 further comprising control means for selectively retrieving a set of parameters for a prevailing hearing situation.

7. A hearing aid as claimed in claim 1 further comprising means for intermittently operating said analog-to-digital converters.

8. A hearing aid as claimed in claim 1 wherein said plurality of signal processing stages comprise a plurality of analog signal processing stages.

9. A hearing aid as claimed in claim 1 wherein said plurality of signal processing stages comprise a plurality of digital signal processing stages.

10. A hearing aid as claimed in claim 1 wherein said plurality of signal processing stages include signal processing stages selected from the group consisting of a preamplifier stage, an automatic gain control stage, a filter stage, a peak clipping stage, and a post-amplifier stage.

* * * * *